US010911853B1

(12) United States Patent
Fletcher

(10) Patent No.: US 10,911,853 B1
(45) Date of Patent: Feb. 2, 2021

(54) MUSICAL INSTRUMENT AMPLIFIER-MOUNTED MICROPHONE ASSEMBLY

(71) Applicant: Norman F. Fletcher, Ashland, OR (US)

(72) Inventor: Norman F. Fletcher, Ashland, OR (US)

( * ) Notice: Subject to any disclaimer, the term of this patent is extended or adjusted under 35 U.S.C. 154(b) by 28 days.

(21) Appl. No.: 16/526,487

(22) Filed: Jul. 30, 2019

Related U.S. Application Data

(60) Provisional application No. 62/838,700, filed on Apr. 25, 2019.

(51) Int. Cl.

| | |
|---|---|
| ***H04R 19/01*** | (2006.01) |
| ***H04R 1/04*** | (2006.01) |
| ***H04R 19/04*** | (2006.01) |
| ***H04R 1/08*** | (2006.01) |
| ***H04R 1/28*** | (2006.01) |
| ***H04R 3/00*** | (2006.01) |
| ***H04R 1/02*** | (2006.01) |

(52) U.S. Cl.
CPC ..... *H04R 1/04* (2013.01); *H04R 1/025* (2013.01); *H04R 1/08* (2013.01); *H04R 1/288* (2013.01); *H04R 3/00* (2013.01); *H04R 19/01* (2013.01); *H04R 19/04* (2013.01); *H04R 2420/09* (2013.01)

(58) Field of Classification Search
CPC ... H04R 1/04; H04R 1/08; H04R 3/00; H04R 19/04; H04R 19/01; H04R 1/288; H04R 1/025; H04R 2420/09
See application file for complete search history.

(56) References Cited

U.S. PATENT DOCUMENTS

| | | | |
|---|---|---|---|
| 4,232,205 | A | 11/1980 | Ribeyre |
| 4,437,189 | A | 3/1984 | Newman |
| 4,805,728 | A | 2/1989 | Carter et al. |
| 5,926,554 | A | 7/1999 | Hasenmaier |
| 6,434,240 | B1 | 8/2002 | Kulas |
| 6,498,859 | B2 | 12/2002 | Kuerti et al. |
| 6,644,614 | B1 | 11/2003 | Chen |
| 6,842,528 | B2 | 1/2005 | Kuerti et al. |
| 8,121,332 | B2 | 2/2012 | Johnson |

(Continued)

*Primary Examiner* — Brian Ensey
(74) *Attorney, Agent, or Firm* — Jerry Haynes Law

(57) ABSTRACT

An musical instrument amplifier-mounted microphone assembly operatively attaches to the seal of an instrument speaker to capture sound waves, without losing unique sounds. The microphone assembly utilizes electret condenser microphones to achieve boundary layer configuration. The microphone assembly fits flush against, or parallel to, the speaker baffle that holds the microphone assembly in front of speaker cones. The microphone assembly mounts on a circuit board which acts as a reflective surface to achieve boundary layer effect. The flat circuit board provides flat conductor traces that carry audio signals from the electret assembly, past the gasket seal of the speaker, to electronics on the board that power, amplify and match impedances needed to pass the audio signal to a large venue amplification system. A connector terminal on the circuit board connects via a shielded cable to a housing mounted XLR connector that provides connection to a large venue amplification system.

20 Claims, 8 Drawing Sheets

(56) References Cited

U.S. PATENT DOCUMENTS

| | | | | |
|---|---|---|---|---|
| 8,885,855 | B2 * | 11/2014 | Van Dijk | H04R 1/342<br>381/313 |
| 10,110,980 | B2 | 10/2018 | Epping | |
| 10,321,228 | B2 * | 6/2019 | Smith | H04R 1/08 |
| 10,419,841 | B2 * | 9/2019 | Sibbald | H04R 5/033 |
| 2009/0180656 | A1 | 7/2009 | Benditt | |
| 2019/0028788 | A1 | 1/2019 | Ducker | |

* cited by examiner

MUSICAL INSTRUMENT AMPLIFIER-MOUNTED MICROPHONE ASSEMBLY

CROSS-REFERENCE TO RELATED APPLICATIONS

This application claims the benefit of U.S. provisional application No. 62/838,700, filed Apr. 25, 2019 and entitled INSTRUMENT-MOUNTED BOUNDARY LAYER MICROPHONE DEVICE, which provisional application is incorporated by reference herein in its entirety.

FIELD OF THE INVENTION

The present invention relates generally to a musical instrument amplifier-mounted microphone assembly designed to be mounted inside a musical instrument amplifier. More so, the present invention relates to an electret condenser microphone that includes a boundary layer technology configuration to transfer optimal audio signals from an instrument speaker to the microphone; whereby the microphone assembly fixedly mounts flush against, or parallel to, the baffle seal of the instrument amplifier speaker; whereby the microphone comprises a boundary limit element that mounts on a flat circuit board, such that the boundary limit element acts as a relative surface to the boundary layer; whereby the flat circuit board has flat conductors that carry the signal from the electret microphone assembly, across the seal of the instrument speakers to processing electronics that connect to a venue public address system; and whereby the flat surface of the circuit board serves as a reflective surface for the boundary layer element.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Those skilled in the art will recognize that musical instrument amplifiers for electric guitars, violins, harmonicas and other specialty instruments are thought of by the artists as part of the musical instrument they play in performance. It is important to note that the speaker output from the artist's amplifier is unique. It is also known that when artists perform in large venues, the amplifier played by the artist is often not powerful enough to engage the audience and balance with sound output from other instruments onstage.

The venue sound engineer therefore needs to amplify the artist's speaker output in the venue sound system to achieve control for balance of sound. The sound engineer has two choices: secure a direct output from the artist's preamplifier, bypassing the speaker and therefore losing the actual artist's particular tone quality; or place a microphone and/or a microphone stand in front of the amplifier's speaker, so as to preserve the artist's tone. Bypassing the speaker loses the advantage of capturing the artist's unique sound, but it is easier and much faster for the venue sound engineer. Setting up the microphone assembly in front of the speaker helps retain the artist's unique sound but is time consuming and cumbersome.

Other proposals have involved capturing sound from an onstage speaker. The problem with these microphone devices is that they do not provide the tactical audio advantage of a direct output of audio signal without the loss of the artist's unique sound. Also, the prior art microphone devices do not leverage the advantages provided by boundary layer technology directly in front of the instrument speaker. Even though the above cited microphone devices meet some of the needs of the market, a musical instrument amplifier-mounted microphone assembly that includes boundary layer technology to transfer optimal audio signals from the microphone, across the gasket seal of a speaker to a venue system, is still desired.

SUMMARY

Illustrative embodiments of the disclosure are generally directed to a musical instrument amplifier-mounted microphone assembly that is designed to be mounted inside a musical instrument amplifier. Specifically, the musical instrument amplifier-mounted microphone assembly is configured to mount on a circuit board, which may be a flat metal member with embedded conductors that holds a microphone assembly in front of a speaker, and an electronic circuitry across the gasket and outside the speaker circumference. The musical instrument amplifier-mounted microphone assembly attaches to the speaker baffle on the outside of the speaker seal and holds the electret microphone in front of the speaker's cone.

The musical instrument amplifier-mounted microphone assembly operatively attaches in front of an instrument speaker to capture sound waves, i.e., audio signals, without losing an artist or musical instrument's unique sound. The microphone assembly is configured to convert sound waves to an electrical signal. The electrical signal passes through flat conductors embedded in the circuit board across the gasket seal of the speaker to an area outside of the speaker so that the connections can be made to an outside venue public address system, which carries the sound to an audience. This highlights one of the unique features of the present invention, which is the capacity to get the microphone connections across the gasket seal of the speaker for subsequent sound amplifications.

In some embodiments, the microphone assembly utilizes an electret condenser microphone combined with boundary layer technology to transfer an audio signal from the electret microphone, across the gasket seal of the speaker, to electronics that connect to a venue public address system. In this manner, audio signal, i.e., sound, is picked up from the speakers, while phase interference between direct and reflected sound is minimized because of the boundary layer effect. This results in a natural sound with a flatter frequency response, such that the unique sound of the artist and musical instrument is retained.

In one possible embodiment of the musical instrument amplifier-mounted microphone assembly, the microphone assembly, fixedly and unobtrusively, mounts flush against an instrument amplifier speaker, and specifically across the seal of the instrument speakers. A housing mounted XLR connector extends from the electret condenser microphone, across the gasket seal of the speaker to the processing electronics. The microphone assembly provides a flat circuit board that mounts flush against the seal of the instrument speakers. The boundary limit element mounts on a flat circuit board. The flat surface of the circuit board serves as a reflective surface for the boundary layer element. The flat circuit board has flat conductors that carry the audio signal across the seal of the instrument speakers from the electret condenser microphone.

In another aspect, the musical instrument amplifier-mounted microphone assembly comprises an exterior case defined by a speaker side and a stage side, the exterior case being operable to be disposed flush against the baffle of a speaker, the speaker mounted on an amplifier speaker baffle, the speaker being operable to convert electromagnetic waves into sound waves, the seal of the speaker forming an air seal.

The microphone assembly may also include a vibration dampening rubber panel overlaying the stage side of the exterior case.

The microphone assembly may also include a microphone housing at least partially embedded in the exterior case.

The microphone assembly may also include a microphone comprising a diaphragm, the microphone being encapsulated in the microphone housing, the microphone being operable to convert sound waves to an electrical signal.

The microphone assembly may also include a housing mounted XLR connector operatively extended between the microphone and processing circuitry located past the gasket seal of the speaker.

The microphone assembly may also include an electronic circuitry operable to power the microphone.

The microphone assembly may also include at least one flat conductor operable to carry the electrical signal across the seal of the speaker from the microphone and to the electronic circuitry.

The microphone assembly may also include a circuit board defined by a flat surface and a plurality of mount holes, the circuit board carrying the microphone housing, the circuit board being positioned between the seal of the speaker and the amplifier speaker baffle without breaking the air seal formed by the seal.

The microphone assembly may also include a boundary layer element mounted on the flat surface of the circuit board, whereby the flat surface is operable as a reflective surface for the boundary layer element.

The microphone assembly may also include a mounting structure retaining the microphone, such that the electret microphone diagram is disposed at a fixed distance from the flat surface of the circuit board, thereby creating the boundary layer configuration.

In another aspect, the microphone assembly further comprises an illumination portion operatively connected to the circuitry, the illumination portion operable to indicate the power status of the microphone.

In another aspect, the microphone comprises an electret condenser microphone.

In another aspect, the microphone system is mounted inside a musical instrument amplifier.

In another aspect, the exterior case has a flat, elongated shape.

In another aspect, the illumination portion comprises a Phantom On LED light.

In another aspect, the vibration dampening rubber panel has a thickness of about 3/16".

In another aspect, the external electric connector is an XLR connector.

One objective of the present invention is to provide a boundary layer microphone that efficiently captures sound waves from an instrument speaker, while disposed in a flush, parallel relationship in front of the speaker.

Another objective is to provide the tactical audio advantage of a direct output of audio signal without the loss of the artist's unique sound.

Another objective is to obtain, a frequency independent, hemispherical directional characteristic electrostatic transducer with a high acoustical quality.

Another objective is to utilize boundary layer technology to transfer audio signal from the electret condenser microphone, across the seal of the speaker to external electrical circuitry.

Yet another objective is to amplify the unique sound and tone of the artist from the speaker's amplifier.

Yet another objective is to provide an inexpensive to manufacture instrument-mounted boundary layer microphone assembly.

Other systems, assemblies, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1A shows a speaker side of the assembly and an electret condenser microphone, and FIG. 1B shows a stage side of the assembly, in accordance with an embodiment of the present invention;

FIG. 3A shows a frontal view, and FIG. 3B shows an elevated side view, in accordance with an embodiment of the present invention; FIG. 4A shows a frontal view, and FIG. 4B shows an elevated side view, in accordance with an embodiment of the present invention

FIG. 9A shows a frontal view, FIG. 9B shows a top view, an alternative mount structure is shown in FIG. 9C which shows a side view, and FIG. 9D shows a top view, in accordance with an embodiment of the present invention;

FIG. 10A shows a top view, and FIG. 10B shows an elevated side view, in accordance with an embodiment of the present invention;

FIG. 13A shows the mounting structure, and FIG. 13B shows the electret microphone with FET, in accordance with an embodiment of the present invention;

Like reference numerals refer to like parts throughout the various views of the drawings.

DETAILED DESCRIPTION OF THE INVENTION

Figure 1A:
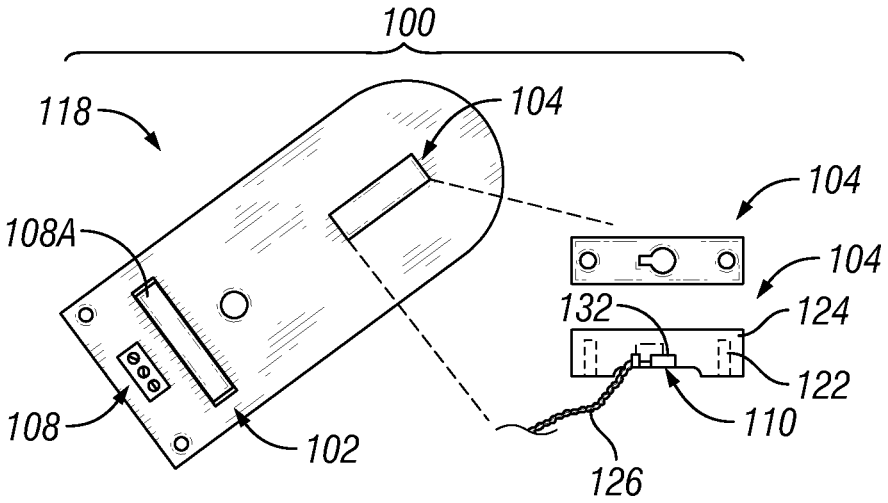
FIGS. 1A and 1B illustrate a perspective view of an exemplary musical instrument amplifier-mounted microphone assembly, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific assemblies and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A musical instrument amplifier-mounted microphone assembly is referenced in FIGS. 1-15. The musical instrument amplifier-mounted microphone assembly, hereafter "microphone assembly 100" is designed to be mounted inside a musical instrument amplifier. The microphone assembly 100 provides a unique boundary layer technology microphone 110 that mounts flush against the seal 202 of an instrument speaker 200 to capture audio signals, i.e., sound emanating from the speaker, without losing an artist or musical instrument's unique sound characteristics. This highlights one of the unique features of the present invention, which is the capacity to get the microphone connections across the gasket seal of the speaker for subsequent sound amplifications.

Once mounted against the speaker 200, the boundary layer technology microphone 110 has no further need for adjustment and can be regularly used by the artist as a means of connection to venue audio systems. In this manner, the microphone assembly 100 has the tactical advantage of a direct audio output with the ability to capture the unique instrument amplifier speaker sound. In some embodiments, the microphone assembly 100 mounts on a circuit board, which may be a flat metal member with embedded conductors that holds a microphone assembly in front of a speaker, and an electronic circuitry across the gasket and outside the speaker circumference. The musical instrument amplifier-mounted microphone assembly attaches to the speaker baffle on the outside of the speaker seal and holds the electret microphone in front of the speaker's cone.

In function, the microphone assembly 100 is configured to convert sound waves to an electrical signal. The electrical signal is then passed through flat conductors embedded in the circuit board across the gasket seal of the speaker to an area outside of the speaker so that the connections can be made to an outside venue public address system 1302, which carries the sound to an audience. This highlights one of the unique features of the present invention, which is the capacity to get the microphone connections across the gasket seal of the speaker for subsequent sound amplifications.

Figure 1B:
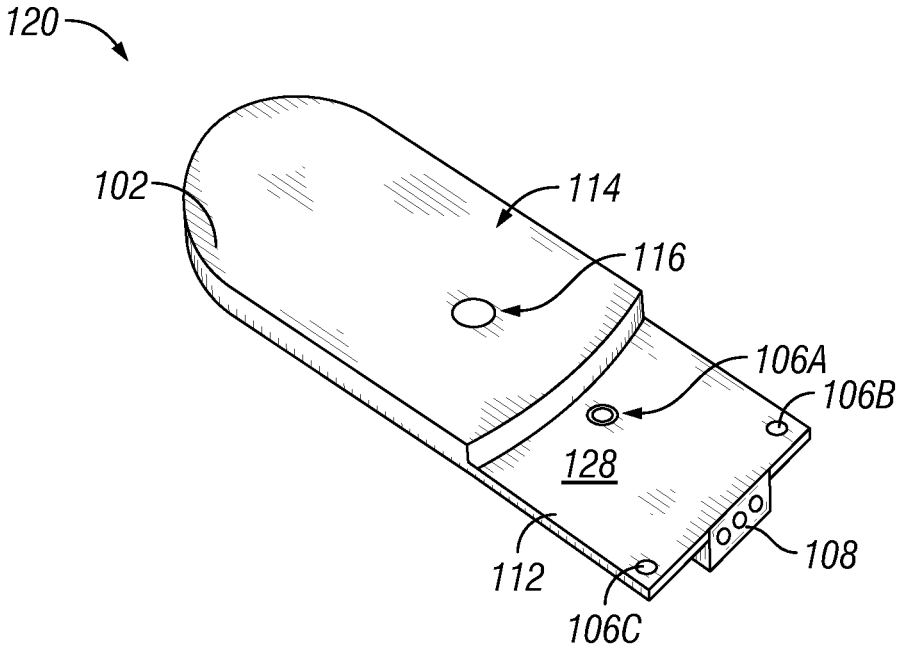

As referenced in FIGS. 1A and 1B, the microphone assembly provides an electret condenser microphone, which is uniquely positioned to having boundary layer technology to capture the unique instrument amplifier speaker sound. The audio signal emanating from the speaker 200 is picked up by the microphone 110. In this manner, the audio signal is changed to an electrical signal and passed to processing electronics, while phase interference between direct and reflected sound is minimized because of the microphone 110 placement in a microphone housing 104 keeps the microphone 110 at a fixed distance about the flat surface of the assembly, thereby creating the boundary layer. Specifically, the microphone 110 creates a frequency independent, hemispherical directional characteristic electrostatic transducer with a high acoustical quality. This results in a natural sound with a flatter frequency response, such that the unique sound of the artist and musical instrument is retained.

In some embodiments, the microphone assembly 100 also provides a circuit board 112 having a flat surface 128. The circuit board 112 is sized and dimensioned to carry the microphone 110. The circuit board 112 positions between the speaker seal 202 and the amplifier speaker baffle 206 without breaking the air seal formed by the seal 202. The microphone assembly 100 also provides a boundary layer element 124 that mounts on the flat surface 128 of the circuit board 112. The flat surface is operable as a reflective surface for the boundary layer element in relation to the speaker seal. Additionally, the microphone assembly 100 is light and robust, so as to withstand the rigors of travel and touring while remaining protected inside the musical instrument amplifier housing.

Figure 2:
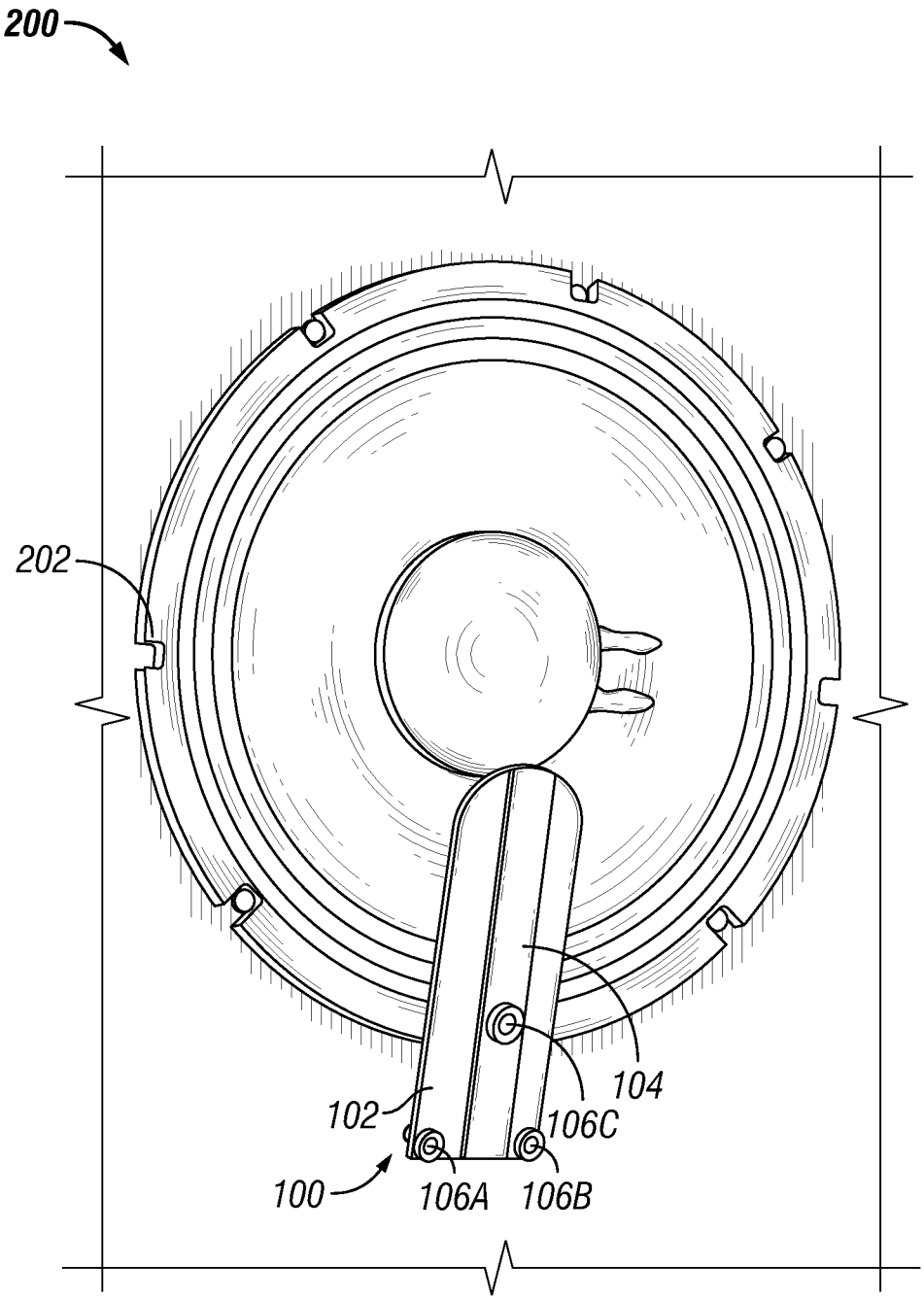
FIG. 2 illustrates a front perspective view of an exemplary musical instrument amplifier-mounted microphone assembly mounted in front of an instrument speaker, in accordance with an embodiment of the present invention.

FIG. 2 references the microphone assembly 100 comprises an exterior case 102 that engages a seal 202 of a speaker 200 in a flush, parallel relationship. In the case of a front mounted speaker, the microphone assembly 100 is parallel to the baffle of the speaker with a degree of standoff. If the speaker is rear mounted, the microphone assembly 100 fits flush against the baffle and makes a slight deformation of the speaker gasket while still maintaining a seal.

The exterior case 102 is defined by a speaker side 118 (FIG. 1A) that presses flush against the seal 202 of the speaker 200, and a stage side 120 (FIG. 1B), oriented away from the speaker and towards the stage. In one possible embodiment, the exterior case 102 has a flat, elongated shape. In some embodiments, the exterior case 102 comprises a potted configuration. The potting of the exterior case 102 fills the body with a solid or gelatinous compound for resistance to shock and vibration, and for exclusion of moisture and corrosive agents. This protects sensitive electronic components from impact, vibration, and loose wires.

Figure 3A:
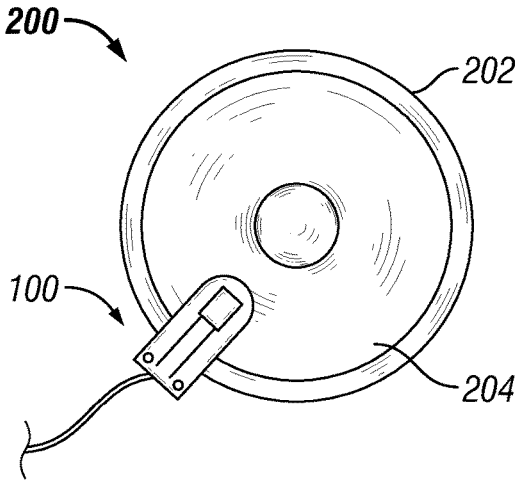
FIGS. 3A and 3B illustrate an exemplary rear mounted speaker and the microphone assembly, showing the microphone assembly positioned between the seal and flush against the speaker baffle, where
Figure 3B:
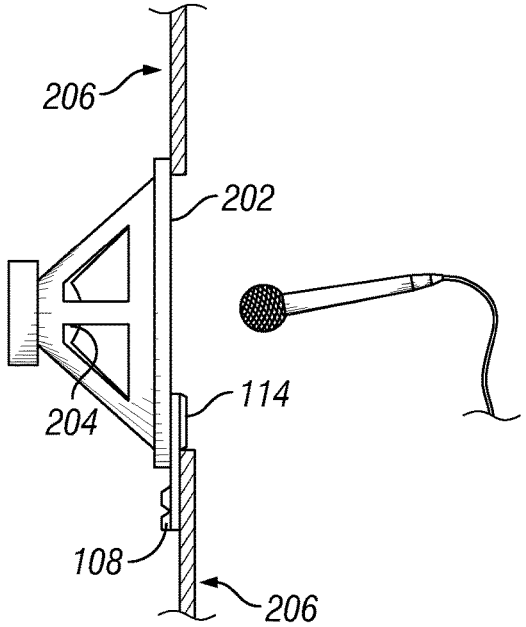
Figure 4A:
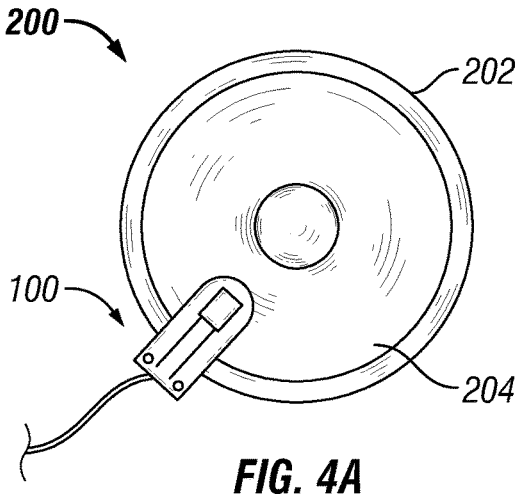
FIGS. 4A and 4B illustrate the front mounted speaker and the microphone assembly, showing the amplifier microphone assembly positioned anterior to the seal and parallel to the amplifier speaker baffle, where
Figure 4B:
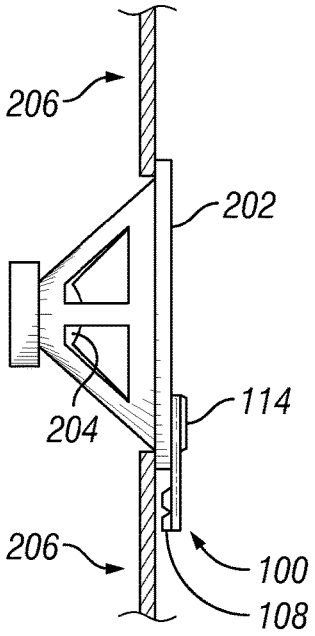

In one non-limiting embodiment shown in FIG. 3A, the speaker 200 mounts inside an instrument amplifier. Though in other embodiments, any type or position of the speaker may be used. FIG. 3B illustrates a rear mounted speaker comprises a cone 204 and an amplifier speaker baffle 206. The seal 202 is part of the speaker itself, and not the electret condenser microphone 110. The speaker seal 202 forms an air seal. An amplifier speaker baffle 206 lies outside a circuit board 112 of the microphone assembly 100, as described below. FIGS. 4A and 4B shows the circuit board 112, anterior to the seal 202 and parallel to the amplifier speaker baffle 206 without breaking the air seal that the seal 202 forms.

Figure 5:
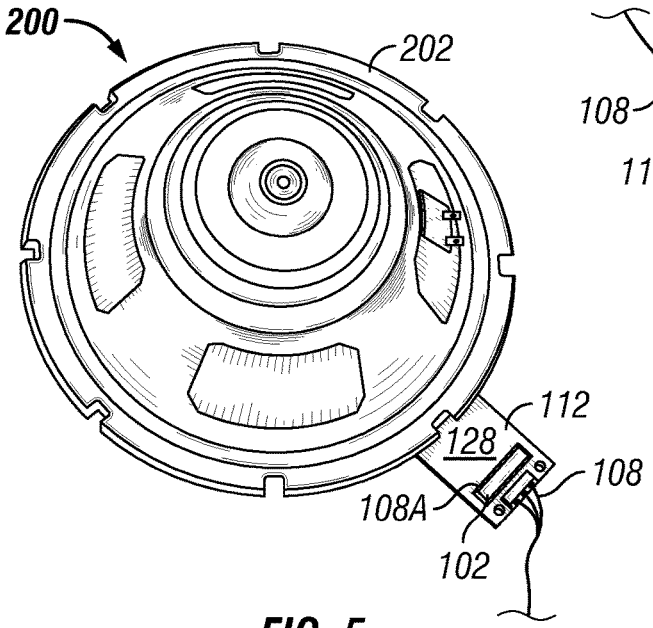
FIG. 5 illustrates a rear perspective view of an exemplary speaker with the microphone assembly mounted thereto, in accordance with an embodiment of the present invention.

In other embodiments, a vibration dampening rubber panel 114 overlays the stage side 120 of the exterior case 102. The vibration dampening rubber panel 114 may have a thickness of about 3/16". The vibration dampening rubber panel 114 comprises a heavy dampening material such as rubber on the back side of the circuit board. The vibration dampening rubber panel 114 is configured to prevent unwanted oscillations in the presence of high sound pressure levels. As shown in FIG. 5, a microphone housing 104 is configured to at least partially embed inside the exterior case 102. The microphone housing 104 may include a rubber or plastic rectangular component that snugly receives a microphone 110, described below. Once mounted in the microphone housing 104, the microphone 110 has no further need for adjustment and can be regularly used by the artist as a means of connection to venue audio systems.

In some embodiments, a microphone 110 is at least partially encapsulated in the microphone housing 104, which is itself encased in the larger exterior case 102. The microphone housing 104 and the microphone 110 contained therein, are light and robust, able to withstand the rigors of travel and touring while remaining protected inside the musical instrument amplifier housing. In this manner, the microphone 110 can have the tactical advantage of a direct output with the ability to capture the unique instrument amplifier speaker sound.

As illustrated in FIG. 3, the microphone 110 comprises a diaphragm 132, and is configured to generate a stronger audio signal through use of a capacitor to convert acoustical energy into electrical energy. In one non-limiting embodiment, the microphone 110 is an electret condenser microphone. Though other types of microphones may also be used. The microphone 110 is fitted anterior to the speaker 200, so as to obtain a frequency independent, hemispherical directional characteristic with a high tonal quality. In one non-limiting embodiment, the electret condenser microphone 110 comprises integrated Field Effect Transistor that is chosen for especially high Sound Pressure Levels before distortion.

Figure 8:
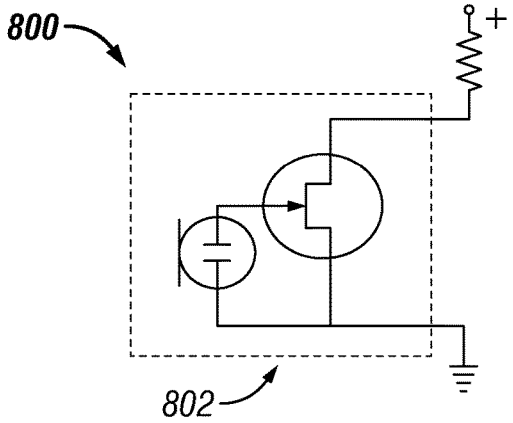
FIG. 8 illustrates a schematic diagram of the electret condenser microphone, in accordance with an embodiment of the present invention.
Figure 9A:
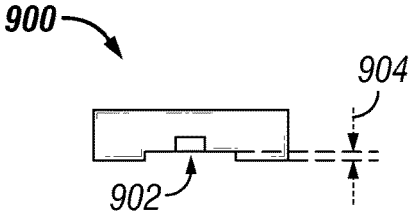
FIGS. 9A-9D illustrates an exemplary mount structure that supports the electret condenser microphone, where
Figure 9B:
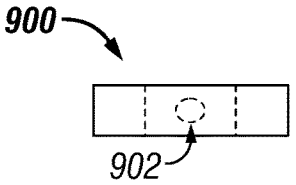
Figure 9C:
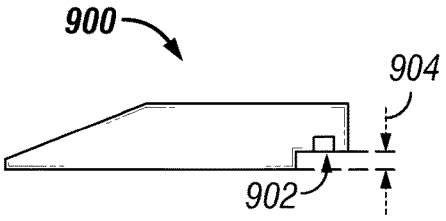
Figure 9D:
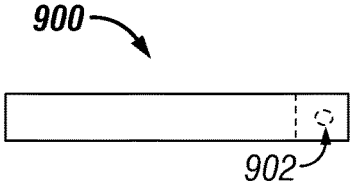

FIG. 8 references the schematics 800 of the microphone 110. As shown the schematics 800 are contained in a capsule 802 for easier portability and protection from damage. Continuing with the electrical electronic circuitry 108 of the microphone assembly 100. The microphone 110 receives power from an electronic circuitry 108, battery, or other external power source, which is connected to a venue public address system 1302. Turning now to FIGS. 9A, 9B, and 9C, at least one mount structure 900 holds the microphone 110 at a fixed distance from a flat boundary surface of the circuit board 112. Further, an electret capsule 902 can be used for mounting thereon (FIG. 9D). In this manner, a boundary layer effect 904 is achieved in the human hearing range, which may be about a 1 mm boundary layer distance 904.

Figure 15:
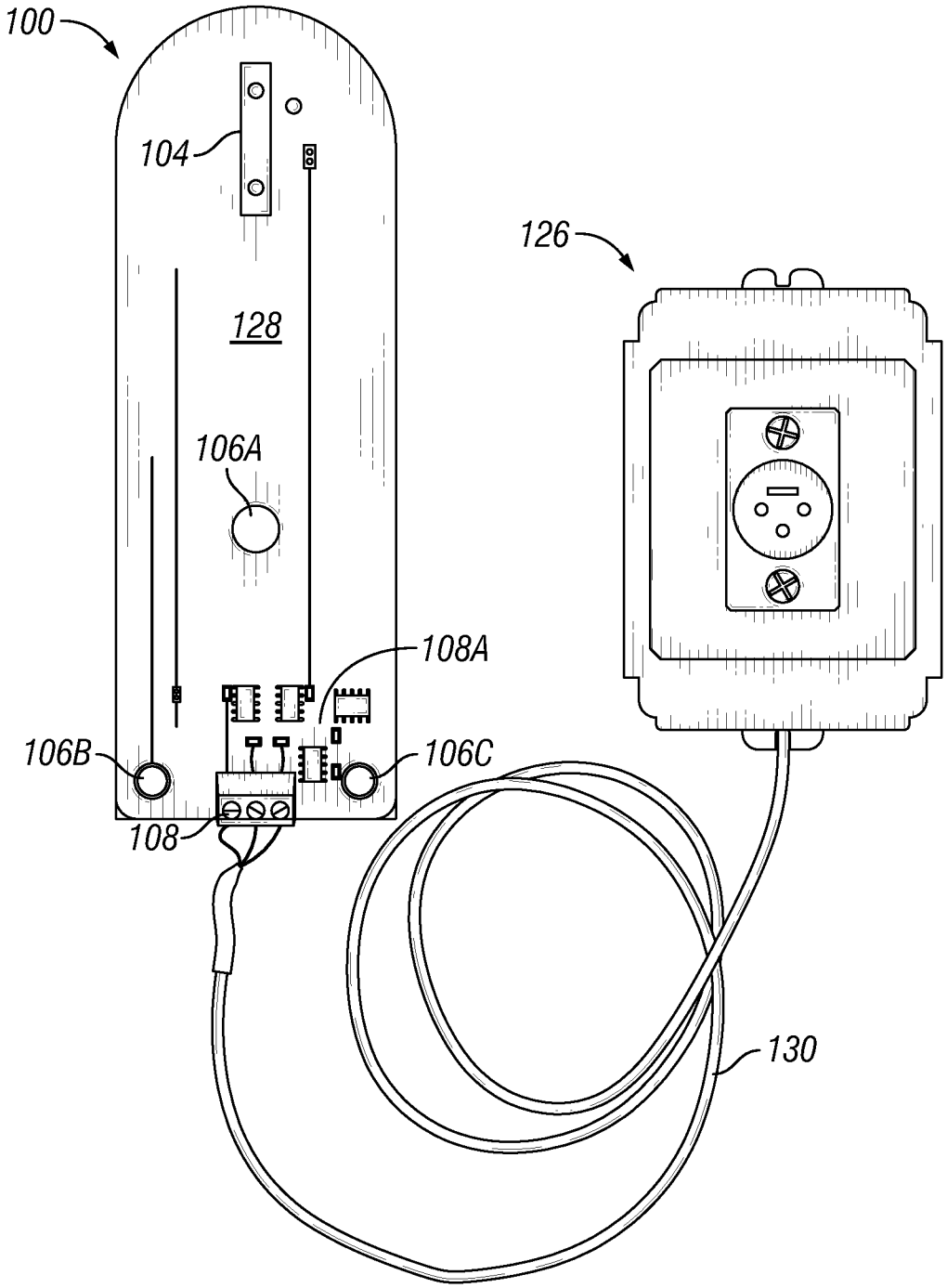
FIG. 15 illustrates a perspective view of a microphone assembly and a housing mounted XLR connected via an electric cable, in accordance with an embodiment of the present invention.

Also, as FIG. 15 shows, a housing mounted XLR connector 126 can be used for audio connectivity. In one non-limiting embodiment, the housing mounted XLR connector 126 is an electrical wire connector to an electret microphone. The housing mounted XLR connector 126 is connected to the output connection terminal 108*a* of the microphone 110 through a shielded electric cable 130. The housing mounted XLR connector 126 may include an electrical connector that is circular in design and has between three and seven pins. In one non-limiting embodiment, the microphone assembly 100 has a terminal strip that is to be connected to an external XLR socket. The XLR external XLR socket is used to connect to an outside venue public address system 1302 and is used to supply phantom power to the microphone 110. Further, an electronics circuitry 108, having at least one connection terminal 108*a* is operable to power the microphone 110. The electronic circuitry 108 may include wires, resistors, voltage devices, and other electrical components known in the art. The electronic circuitry 108 operatively connects to a venue public address system 1302 to carry the sound waves to an audience.

Figure 10A:
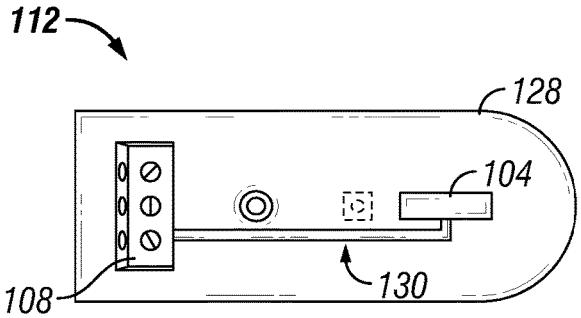
FIGS. 10A and 10B illustrates an exemplary circuit board, showing the flat surface side, where
Figure 10B:
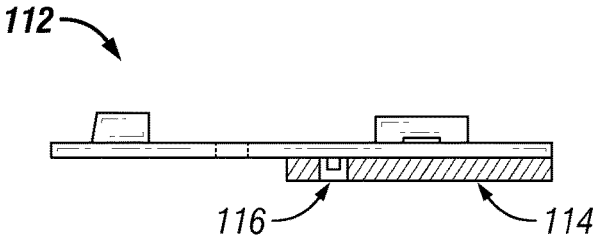
Figure 11:
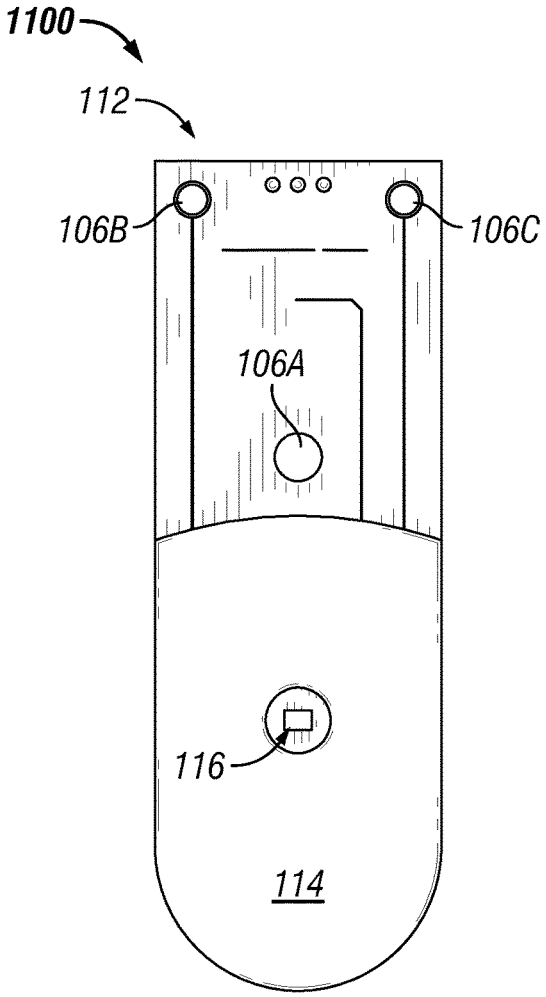
FIG. 11 illustrates a top view of the circuit board, showing the stage side, in accordance with an embodiment of the present invention.
Figure 12:
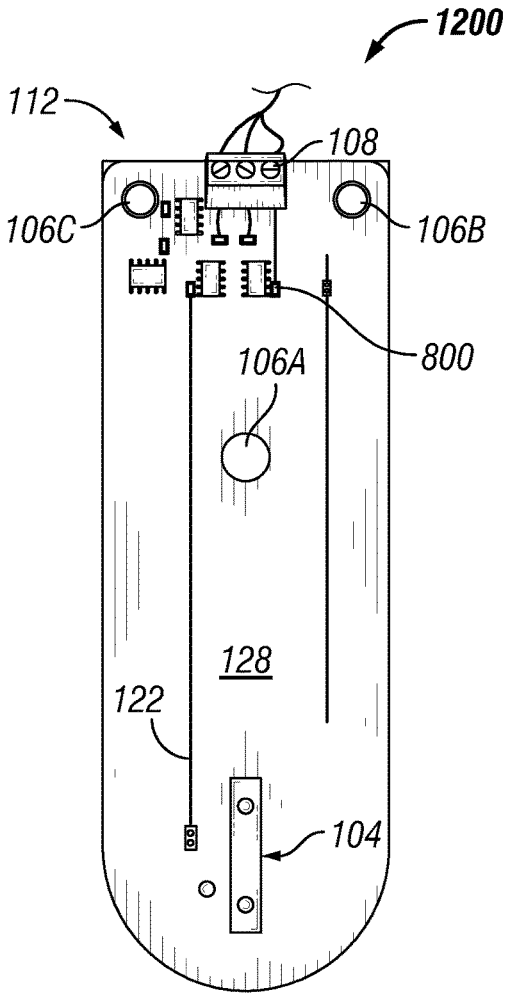
FIG. 12 illustrates a top view of the circuit board, showing the speaker side, in accordance with an embodiment of the present invention.

Tuning now to FIGS. 10A and 10B, the microphone assembly 100 further comprises a circuit board 112. The circuit board 112 is defined by a flat surface 128 that is arranged to press flush against, or parallel to, the baffle of the instrument amplifier speaker, forming an adjacent, parallel relationship therewith. This adjacent, parallel relationship is useful for transferring audio signal with boundary technology. FIG. 11 illustrates a top view of the circuit board 112, showing a first side 1100, which faces away from the speaker 200. FIG. 12 illustrates a top view of the circuit board, showing a second side 1200, which faces towards the speaker 200. The circuit board 112 is flat in shape. Continuing with the construct of the microphone assembly 100, at least one flat conductor trace 122 is integral with the circuit board 112. The flat conductor trace 122 is configured to carry an audio signal across the seal of the speaker, and from the electret condenser microphone 110 and to the electronic circuitry 108. Put another way, the flat conductors carry sound waves across the gasket seal of the mounted speaker. For example, FIG. 10A illustrates that signal traces can be carried through the flat conductor trace 122. The conductor is flat, so as to maintain the flat configuration of the microphone assembly 100 (FIG. 10B).

Figure 13A:
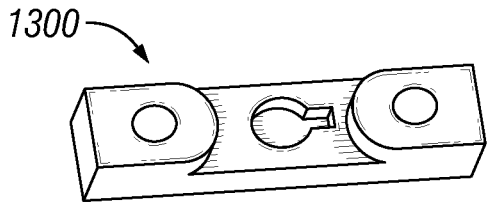
FIGS. 13A and 13B illustrates an exemplary mounting structure and electret microphone with FET, where
Figure 13B:
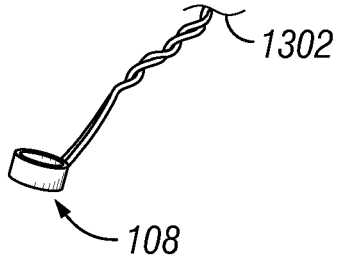
Figure 14:
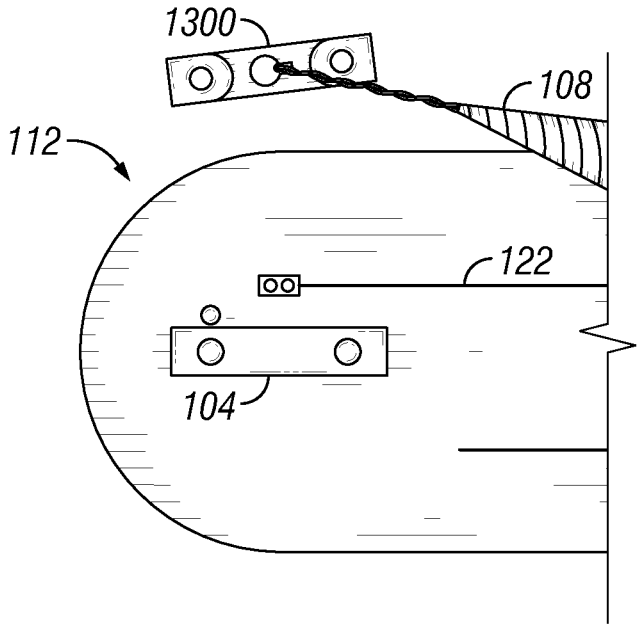
FIG. 14 illustrates a perspective view of the mounting structure supporting the electret microphone above the circuit board, in accordance with an embodiment of the present invention.

In addition, the circuit board 112 provides the structural framework for mounting of the entire system inside a speaker cabinet. Thus, as FIG. 13A shows, the circuit board 112 includes a mounting structure 1300 that holds the electret condenser microphone 110. Thus, FIG. 13B shows that the diaphragm of the electret condenser microphone 110 is at a fixed distance from a flat boundary surface to achieve a boundary layer effect in the human hearing range, about 1 mm. The mounting structure 1300 is sized to hold the electret condenser microphone 110 such that the diaphragm of the electret condenser microphone 110 is at a fixed distance from a flat boundary surface to achieve a boundary layer effect in the human hearing range (FIG. 14). Additionally, the flat surface 128 of the circuit board 112 forms a plurality of mount holes 106*a-c* for fastening to the speaker baffle 206. The mount holes 106*a-c* may include three mount holes 106*a*, 106*b*, 106*c* that receive screws that fasten to the speaker baffle 206. In other embodiments, more mount holes may be used, or other fastening mechanisms may be used.

Through the mounting structure 1300, and the mount holes 106*a-c*, the circuit board 112 provides a flat boundary surface against the seal 202 of the speaker 200. Conductor wires from the electret microphone 110 are connected to signal conductor traces 122 that carry the microphone signal to an electronics processing unit (FIG. 11). This creates a requisite electronic circuit traces to provide mounting of the necessary electronics for the processing unit. In some embodiments, the circuitry and illumination of the microphone assembly 100 utilizes Phantom Power. This is normally provided from a venue PA system when the microphone is plugged in. Included in these traces is a method for attaching a microphone cable via a terminal or other connector. The mounting structure 1300 and the mount holes 106*a-c* provide the structural framework for mounting of the entire system inside a speaker cabinet, for example.

In some embodiments, the microphone assembly 100 comprises a boundary layer element 124 that mounts on the flat surface of the circuit board 112. The flat surface of the circuit board 112 serves as a reflective surface for the boundary layer element 124. Thus, the boundary layer element 124 is mounted on the flat circuit board 112. As shown in FIG. 5, the circuit board 112 also contains electronic elements that carry the audio signal and serves as a means to place the microphone 110 in front of the instrument amplifier speaker 200.

Figure 6:
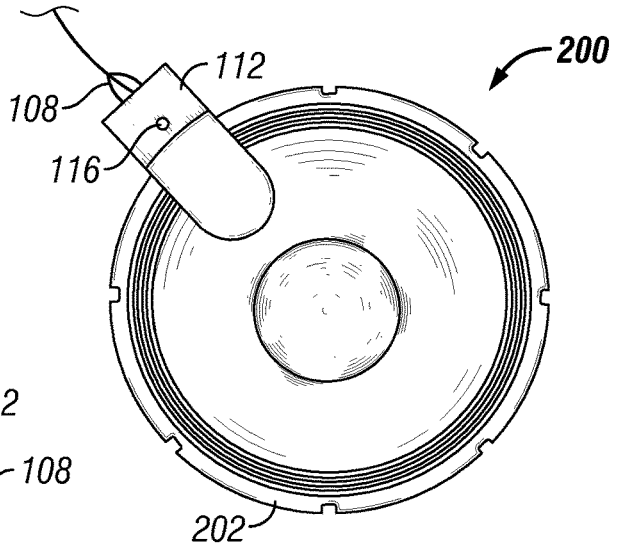
FIG. 6 illustrates a front perspective view of an exemplary speaker with the microphone assembly mounted thereto, in accordance with an embodiment of the present invention.
Figure 7:
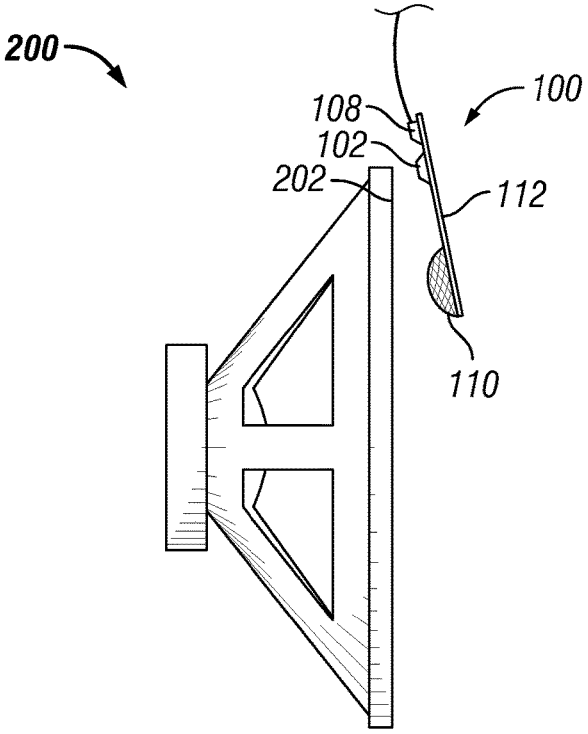
FIG. 7 illustrates a side perspective view of an exemplary speaker with the microphone assembly mounted thereto, in accordance with an embodiment of the present invention.

As FIGS. 6 and 7 reference, the geometrical configuration of the exterior case 102 and the installed location of a boundary layer element 124 within the surface of the circuit board 112 are chosen so that a flat frequency response is obtained at the installed location of the boundary layer element 124. In this manner, the superposition of the incident primary sound field on the secondary sound field created by diffraction does not cause deviation from a flat frequency response and a smooth, hemispherical polar pattern.

Looking again at FIG. 1B, the microphone assembly 100 also provides a visual indicator to identify if the assembly 100 is powered on or off. This many include an illumination portion 116 that operatively connects to the electronic circuitry 108. The illumination portion 116 is configured to indicate the power status of the microphone 110. In one non-limiting embodiment, the illumination portion 116 comprises a Phantom On LED light. The light may flash in a pattern or a steady light. In one embodiment, the illumination portion 116 mounts on the opposite side of the circuit board, and is an LED that provides power ON indication when Phantom Power is present.

In conclusion, the microphone assembly 100 operatively attaches to the baffle of an instrument speaker 200 to capture an audio signal, without losing an artist or musical instrument's unique sound. The microphone assembly 100 utilizes an electret condenser microphone 110 that utilizes boundary layer technology to transfer an audio signal from the electret microphone, across the gasket seal of the speaker to processing electronic circuitry 108. In this manner the audio signal is amplified from the speakers, while phase interference between direct and reflected sound is minimized. The microphone assembly 100, fixedly and unobtrusively, mounts flush against an instrument amplifier speaker baffle, and specifically the seal of the instrument speakers 200.

Continuing, a housing mounted XLR connector 126 extends from the electret microphone and is connected from the microphone 110 to traces. The microphone assembly 100 provides a flat circuit board that mounts flush against the seal of the instrument speakers. The boundary limit element 124 mounts on a flat circuit board. The flat surface of the circuit board serves as a reflective surface for the boundary layer element. The flat circuit board 112 has flat conductors that carry the audio signal from the electret microphone 110, past the seal of the speaker, and to processing electronic circuitry 108.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A musical instrument amplifier-mounted microphone assembly, the assembly comprising:

an exterior case defined by a speaker side and a stage side;

a vibration dampening panel overlaying the stage side of the exterior case;

a microphone housing at least partially embedded in the exterior case;

a microphone comprising a diaphragm, the microphone being encapsulated in the microphone housing, the microphone being operable to convert sound waves to an electrical signal;

a circuit board defined by a flat surface and a plurality of mount holes, the circuit board carrying the microphone housing; and a boundary layer element mounted on the flat surface of the circuit board, whereby the flat surface is operable as a reflective surface for the boundary layer element.

2. The assembly of claim 1, wherein the exterior case is operable to be disposed flush against a seal of a speaker, the speaker being operable to convert electromagnetic waves into the sound waves.

3. The assembly of claim 2, wherein the speaker is a front or rear mounted speaker comprising a cone and an amplifier speaker baffle.

4. The assembly of claim 3, wherein the speaker is mounted inside a musical instrument amplifier.

5. The assembly of claim 4, further comprising a housing mounted XLR connector operatively extended from the microphone across the seal of the speaker to a processing electronic circuitry.

6. The assembly of claim 5, wherein the seal of the speaker forms an air seal.

7. The assembly of claim 6, wherein the electronic circuitry connects to the housing mounted XLR connector operatively extends through a shielded electric cable.

8. The assembly of claim 7, wherein the circuit board positions between the seal of the speaker and the amplifier speaker baffle without breaking the air seal formed by the seal.

9. The assembly of claim 8, further comprising a mounting structure retaining the microphone, such that the microphone diaphragm is disposed at a fixed distance from the flat surface of the circuit board.

10. The assembly of claim 9, wherein the electronic circuitry is operable to power the microphone, the electronic circuitry comprising a connecting terminal, the electronic circuitry connected to a venue public address system.

11. The assembly of claim 10, further comprising at least one flat conductor trace operable to carry the audio signal past the seal of the speaker from the microphone and to the electronic circuitry.

12. The assembly of claim 11, further comprising an illumination portion operatively connected to the electronic circuitry, the illumination portion operable to indicate the power status of the microphone.

13. The assembly of claim 12, wherein the illumination portion comprises a Phantom On LED light.

14. The assembly of claim 1, wherein the microphone comprises an electret condenser microphone.

15. The assembly of claim 1, wherein the exterior case comprising a potted configuration.

16. The assembly of claim 1, wherein the vibration dampening rubber panel has a thickness of about 3/16 inches.

17. A musical instrument amplifier-mounted microphone assembly, the assembly comprising:

an exterior case defined by a speaker side and a stage side, the exterior case being operable to be disposed flush against a seal of a speaker, the speaker comprising an amplifier speaker baffle, the speaker being operable to convert electromagnetic waves into sound waves, the seal of the speaker forming an air seal;

a vibration dampening rubber panel overlaying the stage side of the exterior case;

a microphone housing at least partially embedded in the exterior case;

a microphone comprising a diaphragm, the microphone being encapsulated in the microphone housing, the microphone being operable to convert sound waves to an electrical signal;

a housing mounted XLR connector operatively extended between the surface of the seal of the speaker and the microphone;

an electronic circuitry operable to power the microphone;

at least one flat conductor trace operable to carry the audio signal past the seal of the speaker from the microphone to the electronic circuitry;

a circuit board defined by a flat surface and a plurality of mount holes, the circuit board carrying the microphone housing, the circuit board being positioned between the seal of the speaker and the amplifier speaker baffle without breaking the air seal formed by the seal;

a boundary layer element mounted on the flat surface of the circuit board, whereby the flat surface is operable as a reflective surface for the boundary layer element; and a mounting structure retaining the microphone, such that the amplifier speaker baffle is disposed at a fixed distance from the flat surface of the circuit board.

18. The assembly of claim 17, further comprising an illumination portion operatively connected to the electronic circuitry, the illumination portion operable to indicate the power status of the microphone.

19. The assembly of claim 17, wherein the microphone comprises an electret condenser microphone.

20. A musical instrument amplifier-mounted microphone assembly, the assembly comprising:

a speaker defined by a seal and an amplifier speaker baffle, the speaker being operable to convert electromagnetic waves into sound waves, the seal of the speaker forming an air seal;

an exterior case defined by a speaker side and a stage side, the exterior case being operable to be disposed flush against the seal of the speaker;

a vibration dampening rubber panel overlaying the stage side of the exterior case;

a microphone housing at least partially embedded in the exterior case;

an electret condenser microphone comprising a diaphragm, the electret condenser microphone being encapsulated in the microphone housing, the electret condenser microphone being operable to convert sound waves to an electrical signal;

a housing mounted XLR connector operatively extended between the surface of the seal of the speaker and the electret condenser microphone;

an electronic circuitry operable to power the electret condenser microphone, the electronic circuitry connected to a venue public address system;

an illumination portion operatively connected to the electronic circuitry, the illumination portion operable to indicate the power status of the electret condenser microphone;

at least one flat conductor trace operable to carry the audio signal across the seal of the speaker from the electret condenser microphone and to the electronic circuitry;

a circuit board defined by a flat surface and a plurality of mount holes, the circuit board carrying the microphone housing, the circuit board being positioned between the seal of the speaker and the amplifier speaker baffle without breaking the air seal formed by the seal;

a boundary layer element mounted on the flat surface of the circuit board, whereby the flat surface is operable as a reflective surface for the boundary layer element; and a mounting structure retaining the electret condenser microphone, such that the microphone diaphragm is disposed at a fixed distance from the flat surface of the circuit board.

* * * * *